US007520039B2

(12) United States Patent
Neef

(10) Patent No.: US 7,520,039 B2
(45) Date of Patent: Apr. 21, 2009

(54) METHOD FOR THE POST-TREATMENT OF DEFORMED HIGH-GRADE STEEL BLANKS

(75) Inventor: Manfred Neef, Wilnsdorf-Flammersbach (DE)

(73) Assignee: NEEF GmbH & Co. KG, Wilnsdorf (DE)

( * ) Notice: Subject to any disclaimer, the term of this patent is extended or adjusted under 35 U.S.C. 154(b) by 499 days.

(21) Appl. No.: 10/504,349

(22) PCT Filed: Feb. 11, 2003

(86) PCT No.: PCT/EP03/01332

§ 371 (c)(1),
(2), (4) Date: May 23, 2005

(87) PCT Pub. No.: WO03/068451

PCT Pub. Date: Aug. 21, 2003

(65) Prior Publication Data

US 2006/0037676 A1 Feb. 23, 2006

(30) Foreign Application Priority Data

Feb. 12, 2002 (DE) ..... 102 05 645

(51) Int. Cl.
*B24B 39/00* (2006.01)

(52) U.S. Cl. ..... 29/90.7; 72/53; 451/39

(58) Field of Classification Search ..... 29/90.7; 72/53; 451/39

See application file for complete search history.

(56) References Cited

U.S. PATENT DOCUMENTS

| | | | | |
|---|---|---|---|---|
| 3,086,278 | A * | 4/1963 | Fuchs | 29/90.7 |
| 3,209,862 | A * | 10/1965 | Young | 181/245 |
| 3,972,149 | A * | 8/1976 | Hart | 451/76 |
| 4,287,740 | A * | 9/1981 | Kumar | 72/40 |
| 4,428,213 | A * | 1/1984 | Neal et al. | 72/53 |
| 5,702,289 | A * | 12/1997 | Champaigne | 451/38 |
| 6,038,900 | A * | 3/2000 | Miyasaka | 72/53 |
| 6,170,308 | B1 * | 1/2001 | Veronesi et al. | 72/53 |
| 6,449,998 | B1 * | 9/2002 | Takeda et al. | 72/53 |
| 7,159,425 | B2 * | 1/2007 | Prevey et al. | 72/53 |

FOREIGN PATENT DOCUMENTS

| | | |
|---|---|---|
| CH | 633 988 | 1/1983 |
| DE | 29 36 393 C2 | 1/1987 |
| EP | 0 033 562 | 8/1981 |
| FR | 1 261 595 | 6/1960 |

OTHER PUBLICATIONS

Database WPI, Section PQ, Week 198152, Derwent Publications, Ltd., London, GB; Class P61, AN 1981-N3490D, XP002241363 & SU 814 680 A (ROST Agric Mach Con), Mar. 23, 1981, Abstract.

* cited by examiner

*Primary Examiner*—Essama Omgba
(74) *Attorney, Agent, or Firm*—Pauley Petersen & Erickson

(57) ABSTRACT

A method for post-treatment of single high-grade steel blanks produced from deep-drawable circles or sections of high-grade steel by deep-drawing, pressing, rolling and deformation. According to this invention, the completed blanks are post-treated directly after being produced, in a drum which is hard-faced with hard granulate particles and which moves in a rotating manner. Thus, changes in the surface of the single high-grade steel blanks produced, caused by material stresses occurring during the production process, are avoided, provide the high-grade steel blanks with an optimum appearance.

13 Claims, 1 Drawing Sheet

METHOD FOR THE POST-TREATMENT OF DEFORMED HIGH-GRADE STEEL BLANKS

BACKGROUND OF THE INVENTION

1. Field of the Invention

This invention relates to a method for aftertreatment of one-piece high-grade steel castings, produced from circular high-grade steel blanks or cut-to-size blanks capable of being deep-drawn by deep-drawing, punching, rolling and shaping.

2. Discussion of Related Art

Tensions occur in the material, particularly when producing high-grade steel castings from circular high-grade steel blanks or cut-to-size blanks enclosing a hollow space or partial hollow space of varied sizes, which lead to breaks or cracks in the material, so that the parts produced are no longer suitable for many types of use. Thus many of the high-grade steel castings produced in this way must be considered to be waste. This applies particularly to sleeve-shaped high-grade steel castings, which are used as covers for the ends of motor vehicle exhaust pipes.

For these reasons, such covers of high-grade steel castings are not shaped in one piece from circular high-grade steel blanks or cut-to-size blanks, but are made in the customary way by bending and welding. However, this requires considerably greater production costs, because the weld seam does not only have to be finished, but it also adversely affects the appearance of the high-grade steel blank.

SUMMARY OF THE INVENTION

It is one object of this invention to provide a method of the type mentioned above but in which it is possible to shape high-grade steel castings in one piece from high-grade steel blanks or cut-to-size blanks by using deep-drawing processes, which are protected by a subsequent aftertreatment against stresses occurring in the material relieved in such a way, that the smooth surface of the high-grade steel castings, as well as a high degree of brightness which were achieved, are retained.

In accordance with this invention, the object is achieved because the finished castings are after-treated directly following their production in a drum, which has hard granulate particles put into rotary motion.

It is important, for one, that the high-quality steel castings are put into the drum immediately following their production, wherein the hard granulate particles continuously beat the surfaces of the produced high-quality steel castings, which relieves the stresses in the material and therefore results in avoiding or preventing the surface changes which spoil the amount of brightness. This aftertreatment follows the cost-effective production of the high-grade steel castings and does not entail any substantial increase in costs. In spite of the aftertreatment, the one-piece production of the high-grade steel castings is substantially more cost-effective than the known shaping by bending and welding.

Ceramic particles are preferably used as the granulate particles, which have a diameter of the grain size which is less than twice a radius of rounded convex and/or concave surface areas of the castings.

The deep-drawing, punching, rolling and shaping processes are performed in method steps which follow each other directly.

An aftertreatment is shown to be particularly advantageous wherein the aftertreatment time and/or the number of revolutions of the drum are selected as a function of the thickness of the material and/or the size of the surface of the castings. 1 to 1.2 mm are advantageously selected as the thickness of the material for the covers for motor vehicle exhaust pipes made from high-grade steel castings.

DETAILED DESCRIPTION OF THE DRAWINGS

Figure 1:
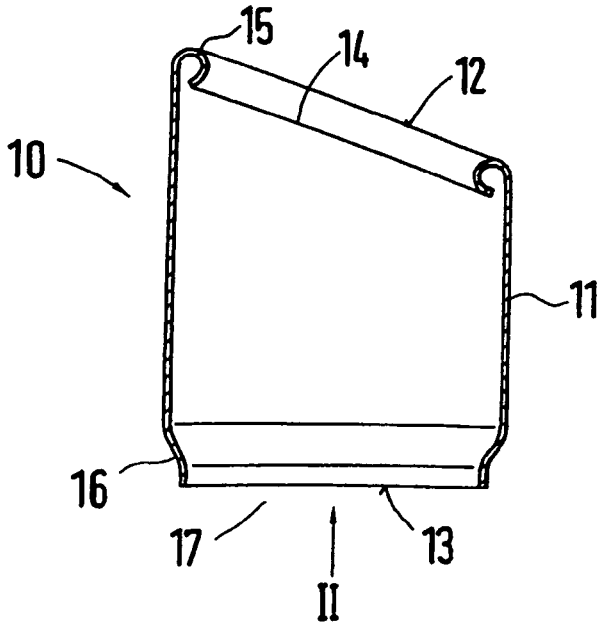
FIG. 1 is a view of a one-piece high-grade steel casting for a cover for the end of a motor vehicle exhaust pipe.

The method of this invention can be advantageously employed in connection with a one-piece high-grade steel casting 10 in FIG. 1, which is produced from a circular high-quality steel blank and is used as a cover for the end of a motor vehicle exhaust pipe. In this embodiment, one front end 12 is beveled, a hole 14 is punched out and a crimped edge 15 is provided around the hole 14. The casing 11 of the cover is drawn in several deep-drawing steps and has been cut off perpendicularly relative to the longitudinal axis in the area of the other front end 13, as shown by the element reference numeral 17. Furthermore, the diameter of the end section 16 is reduced by upsetting in order to prevent return movements of the cover 11 toward the outside.

Figure 2:
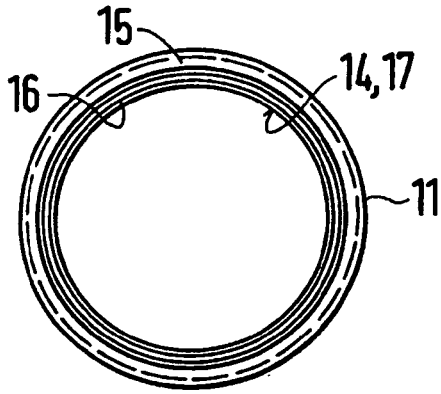
FIG. 2 is a view into the cover from the direction of the front end.
Figure 3:
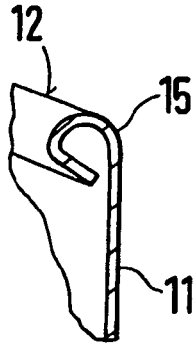
FIG. 3 is a view of the crimped edge of the cover.

FIG. 2 shows the view into the cover 11 from the direction of the front end 17, and FIG. 3 shows the crimped edge 15 in the area of the front end 12, on an enlarged scale.

The invention claimed is:

1. A method for production of a treated one-piece steel casting, the method comprising the steps of:

providing a high-quality steel blank or a cut-to-size blank capable of being deep-drawn of a thickness of a material of 1 mm to 1.2 mm;

producing the steel casting by deep-drawing, punching and rolling the high-quality steel blank or the cut-to-size blank in immediately successive method steps;

aftertreating the steel casting immediately following the producing of the steel casting, the aftertreating performed within a drum including ceramic particles in a rotary motion, the ceramic particles having a diameter of a grain size that is less than twice a radius of at least one of a rounded convex surface area or a rounded concave surface area of the steel casting; and selecting at least one of an aftertreatment time or a number of revolutions of the drum as a function of at least one of the thickness of the material or a size of a surface of the steel casting.

2. The method in accordance with claim 1, wherein the diameter of the grain size of the ceramic particles is less than twice the radius of the rounded convex and the concave surface areas of the castings.

3. The method in accordance with claim 2, wherein the workpieces are used in connection with high-grade steel castings for covers for motor vehicle exhaust pipes with a thickness of the material of 1 mm to 1.2 mm.

4. The method in accordance with claim 1, wherein the workpieces are used in connection with high-grade steel castings for covers for motor vehicle exhaust pipes with a thickness of the material of 1 mm to 1.2 mm.

5. The method in accordance with claim 1, wherein the steel casting is a cover for an end of a motor vehicle exhaust pipe.

6. The method in accordance with claim 5, wherein the producing of the steel casting further comprises:

beveling a first front end of the steel casting;

punching a hole in the steel casting; and providing a crimped edge around the hole.

7. The method in accordance with claim 6, wherein the producing of the steel casting further comprises the step of:

cutting the steel casting perpendicularly relative to a longitudinal axis in an area of a second front end of the steel casting.

8. The method in accordance with claim 7, wherein the producing of the steel casting further comprises the step of:

reducing a diameter of the second front end by upsetting to prevent return movement.

9. The method in accordance with claim 5, wherein the producing of the steel casting further comprises:

deep-drawing the steel casting in several deep-drawing steps.

10. The method in accordance with claim 5, wherein the producing of the steel casting further comprises the step of:

cutting the steel casting perpendicularly relative to a longitudinal axis in an area of a second front end of the steel casting.

11. The method in accordance with claim 10, wherein the producing of the steel casting further comprises the step of:

reducing a diameter of the second front end by upsetting to prevent return movement.

12. The method in accordance with claim 1, wherein the workpieces each comprise a hollow generally cylindrical casing.

13. The method in accordance with claim 1, wherein the steel casting comprises a generally cylindrical casing at least partially enclosing a hollow space.

* * * * *